US011001057B2

(12) United States Patent
Lahiri et al.

(10) Patent No.: US 11,001,057 B2
(45) Date of Patent: May 11, 2021

(54) DROPLET DEPOSITION APPARATUS AND CONTROLLER THEREFOR

(71) Applicant: Xaar Technology Limited, Cambridge (GB)

(72) Inventors: Anirban Lahiri, Cabridge (GB); Stephen Mark Jeapes, Cabridge (GB); Mujahid-ul Islam, Cabridge (GB)

(73) Assignee: XAAR TECHNOLOGY LIMITED, Cambridge (GB)

( * ) Notice: Subject to any disclaimer, the term of this patent is extended or adjusted under 35 U.S.C. 154(b) by 0 days.

(21) Appl. No.: 16/090,010

(22) PCT Filed: Mar. 29, 2017

(86) PCT No.: PCT/GB2017/050882
§ 371 (c)(1),
(2) Date: Sep. 28, 2018

(87) PCT Pub. No.: WO2017/168149
PCT Pub. Date: Oct. 5, 2017

(65) Prior Publication Data

US 2019/0126611 A1 May 2, 2019

(30) Foreign Application Priority Data

Mar. 30, 2016 (GB) ..... 1605372

(51) Int. Cl.
*B41J 29/38* (2006.01)
*B41J 2/045* (2006.01)

(52) U.S. Cl.
CPC ..... *B41J 2/04541* (2013.01); *B41J 2/04543* (2013.01); *B41J 2/04546* (2013.01); *B41J 2/04581* (2013.01); *B41J 2/04588* (2013.01)

(58) Field of Classification Search
CPC ..... B41J 2/04545; B41J 2/04525
See application file for complete search history.

(56) References Cited

U.S. PATENT DOCUMENTS 5,142,296 A 8/1992 Lopez et al.
5,754,193 A 5/1998 Elhatem
(Continued)

FOREIGN PATENT DOCUMENTS

CN 1381351 11/2002
CN 102689510 9/2012
(Continued)

OTHER PUBLICATIONS

International Search Report dated Nov. 8, 2017, in International Application No. PCT/GB2017/0050882 (2 pgs.).
(Continued)

*Primary Examiner* — Lam S Nguyen
(74) *Attorney, Agent, or Firm* — Finnegan, Henderson, Farabow, Garrett & Dunner LLP

(57) ABSTRACT

There is disclosed a controller for controlling two or more groups of nozzles in an array, the controller configured to: encode data blocks into a data stream, wherein each data block denotes how a respective group of nozzles is to be controlled for a droplet period; encode fire codes into the data stream, wherein each fire code is a reserved code that denotes when a respective group of nozzles is to be controlled in accordance with the data block for the droplet period; and wherein the data block precedes the fire code for the respective group of nozzles in the data stream and wherein the fire codes are generated independently of the data blocks.

22 Claims, 8 Drawing Sheets

(56) References Cited

U.S. PATENT DOCUMENTS

Figure 1:
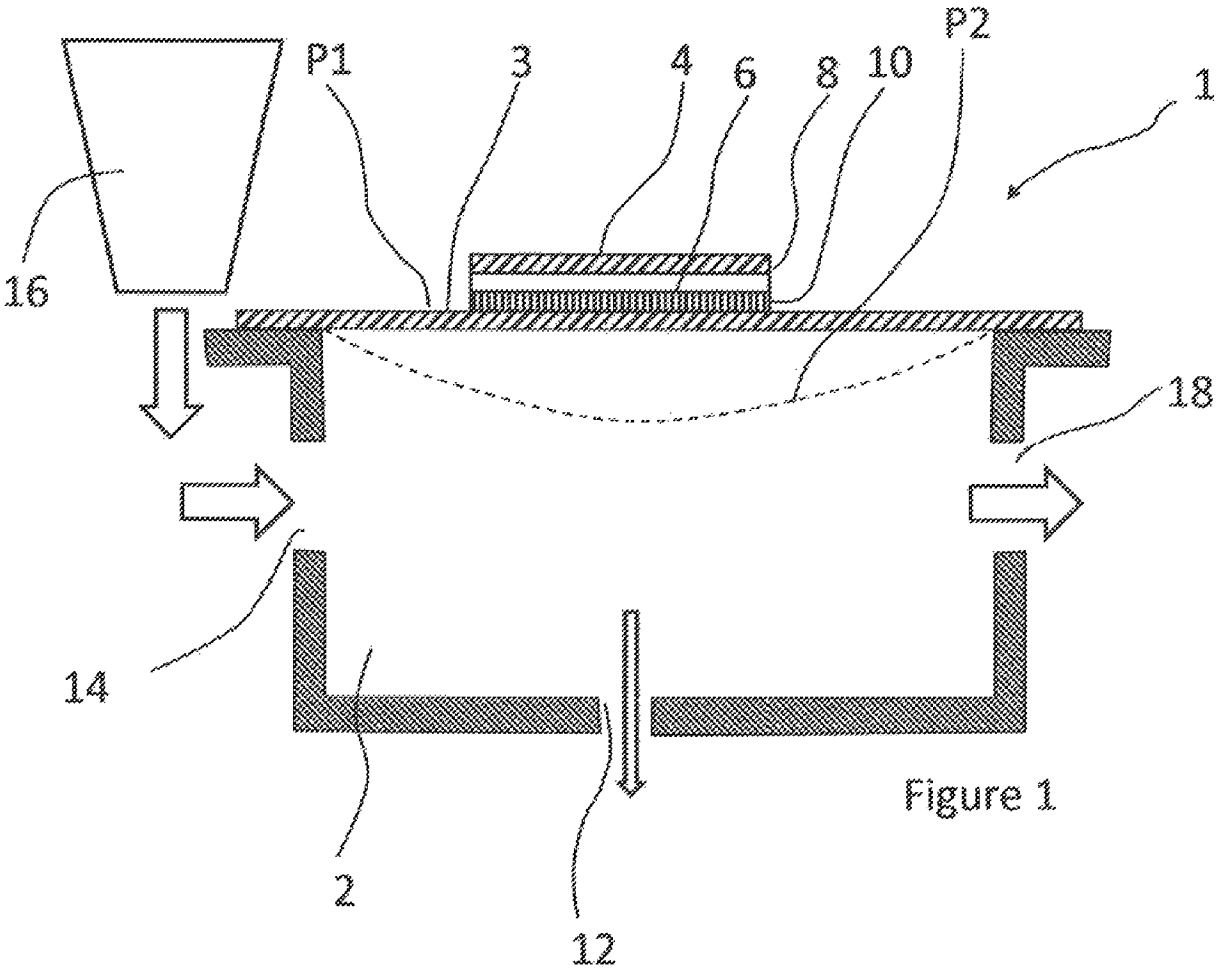

| | | | | |
|---|---|---|---|---|
| 5,896,146 | A | 4/1999 | Murata et al. | |
| 6,130,692 | A | 10/2000 | Mochizuki et al. | |
| 6,828,995 | B1 | 12/2004 | Iwasaki et al. | |
| 6,961,326 | B1 * | 11/2005 | Chang | H04L 29/06 370/338 |
| 7,914,095 | B2 * | 3/2011 | Hayasaki | B41J 2/0455 347/10 |
| 2004/0046830 | A1 | 3/2004 | Mitsuzawa | |
| 2008/0205957 | A1 | 8/2008 | Park et al. | |

FOREIGN PATENT DOCUMENTS

| | | | |
|---|---|---|---|
| CN | 102781673 | | 11/2012 |
| CN | 103974831 | | 3/2016 |
| CN | 104703801 | | 8/2016 |
| EP | 1251006 | A1 | 10/2002 |
| EP | 1301351 | B1 | 9/2006 |
| JP | 2010120328 | A | 6/2010 |
| JP | 2011020329 | A | 2/2011 |
| JP | 2014172341 | A | 9/2014 |

OTHER PUBLICATIONS

Written Opinion of the International Searching Authority dated Nov. 8, 2017, in International Application No. PCT/GB2017/0050882 (6 pgs.).

Search Report of corresponding Chinese application No. 2017800215217 dated Feb. 19, 2020 (2 pages).

Notice of Reasons for Refusal by the Japanese Patent Office dated Feb. 9, 2021, in corresponding Japanese Application No. 2018-550812 (3 pgs.) and machine translation (3 pgs.).

Machine Translation of the Search Report by the Japanese Patent Office dated Dec. 14, 2020, in corresponding Japanese Application No. 2018-550812 (11 pgs.).

* cited by examiner

DROPLET DEPOSITION APPARATUS AND CONTROLLER THEREFOR

This application is a National Stage Entry of International Application No. PCT/GB2017/050882, filed Mar. 29, 2017, which is based on and claims the benefit of foreign priority under 35 U.S.C. § 119 to GB Application No. 1606372.0 filed Mar. 30, 2016. The entire contents of the above-referenced applications expressly incorporated herein by reference.

The present invention relates to a droplet deposition apparatus and controller therefor. It may find particularly beneficial application in a printer, such as an inkjet printer.

Droplet deposition apparatuses, such as inkjet printers are known to eject droplets from nozzles on a droplet deposition head, and to provide for controlled placement of such droplets to create features on a receiving medium.

Conventional systems have actuator arrays in which nozzles are arranged in one or more rows thereon, and further have complex hardware and/or software solutions to drive actuating elements that cause droplets to be ejected from the nozzles.

In some systems the different actuating elements in a row may be driven using code specific to the spacing between the nozzles. For example, for a desired resolution, the pitch between nozzles on the same row may be fixed (e.g. ~21.166 μm for 1200 dpi (dots per inch)), and bespoke code is provided based on the spacing, the resolution and the receiving medium speed (e.g. meter per second (m/s)). However, such code does not take into account variations in manufacturing tolerances or variations in the movement of the receiving medium speed relative to the nozzles, and so the print quality may be reduced.

Furthermore, systems in which there is acceleration/deceleration of a droplet deposition head relative to a receiving medium may sacrifice surface area of the receiving medium to allow for the droplet deposition head to reach a specified velocity. This increases the amount of waste receiving medium generated, which also results in additional costs, and increased run time in awaiting a printing velocity to be reached.

In droplet deposition heads which comprise a large number of nozzles, a correspondingly large amount of data is transferred to the droplet deposition head in order to control droplet ejection from each nozzle. This may cause delays due to the data transfer capabilities of the electronic circuitry that processes per-row to per-nozzle droplet ejection information, as well as timing information to ensure that droplets land in the correct place on the receiving medium.

Therefore, embodiments seek to address the aforementioned problems.

In a first aspect there is provided a controller for controlling two or more groups of nozzles in an array, the controller configured to: encode data blocks into a data stream, wherein each data block denotes how a respective group of nozzles is to be controlled for a droplet period; encode fire codes into the data stream, wherein each fire code is a reserved code that denotes when a respective group of nozzles is to be controlled in accordance with the data block for the droplet period; and wherein the data block precedes the fire code for the respective group of nozzles in the data stream and wherein the fire codes are generated independently of the data blocks.

In another aspect there is provided A controller for controlling nozzles in an array, the controller comprising: switch logic configured to apply drive pulses to the nozzles; circuitry configured to: decode a first data stream received at the controller; identify, in the first data stream, data blocks for respective groups of nozzles and generate a second data stream in response thereto, the second data stream comprising drive data to control the switch logic for a droplet period; identify, in the first data stream, reserved codes that denote when the respective groups of nozzles are to be controlled in accordance with the data blocks, and generate fire signals to control the switch logic in response to the reserved codes; and wherein the circuitry is further configured to, for a first droplet period: control the switch logic for a first group of the nozzles in response to first drive data and a first fire signal; and independently control the switch logic for a second group of nozzles in response to second drive data and a second fire signal.

In a further aspect there is provided a droplet deposition apparatus comprising a controller.

In a further aspect there is provided a droplet deposition head having a controller.

In a further aspect there is provided a method of controlling two or more groups of nozzles in an array, the method comprising: generating, at a first controller, a first data stream comprising encoded data blocks, wherein each encoded data block denotes how a respective group of nozzles is to be controlled for a droplet period; encoding, at the first controller, fire codes into the first data stream, wherein each fire code is a reserved code that denotes when a respective group of nozzles is to be controlled in accordance with the encoded data block for the droplet period, and wherein the encoded data block precedes the fire code for the respective group of nozzles in the data stream.

In a further aspect there is provided a method of controlling two or more groups of nozzles in an array, the method comprising: decoding, at a controller, a first data stream; identifying, in the first data stream, data blocks for respective groups of nozzles; identifying, in the first data stream, reserved codes that denote when the respective groups of nozzles are to be controlled in accordance with the data blocks; generating, in response to the first data stream, fire signals and a second data stream comprising drive data for respective groups of nozzles; controlling switch logic for a first droplet period to apply drive pulses to a first group of nozzles in response to first drive data and a first fire signal; independently controlling switch logic for the first droplet period to apply drive pulses to a second group of nozzles in response to second drive data and a second fire signal.

Figures 2A, 2B, 2C, 2D, 2E:
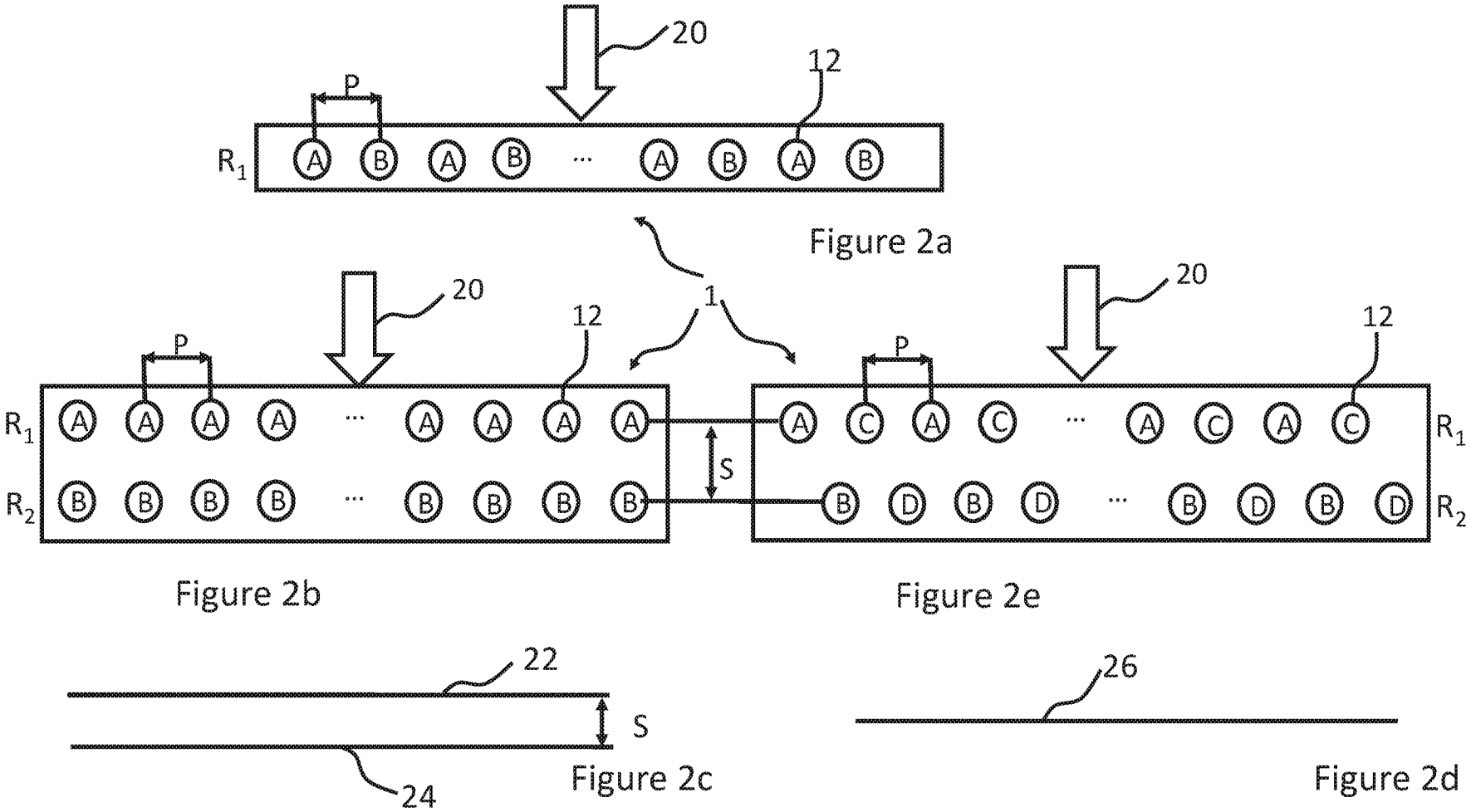
Figure 3:
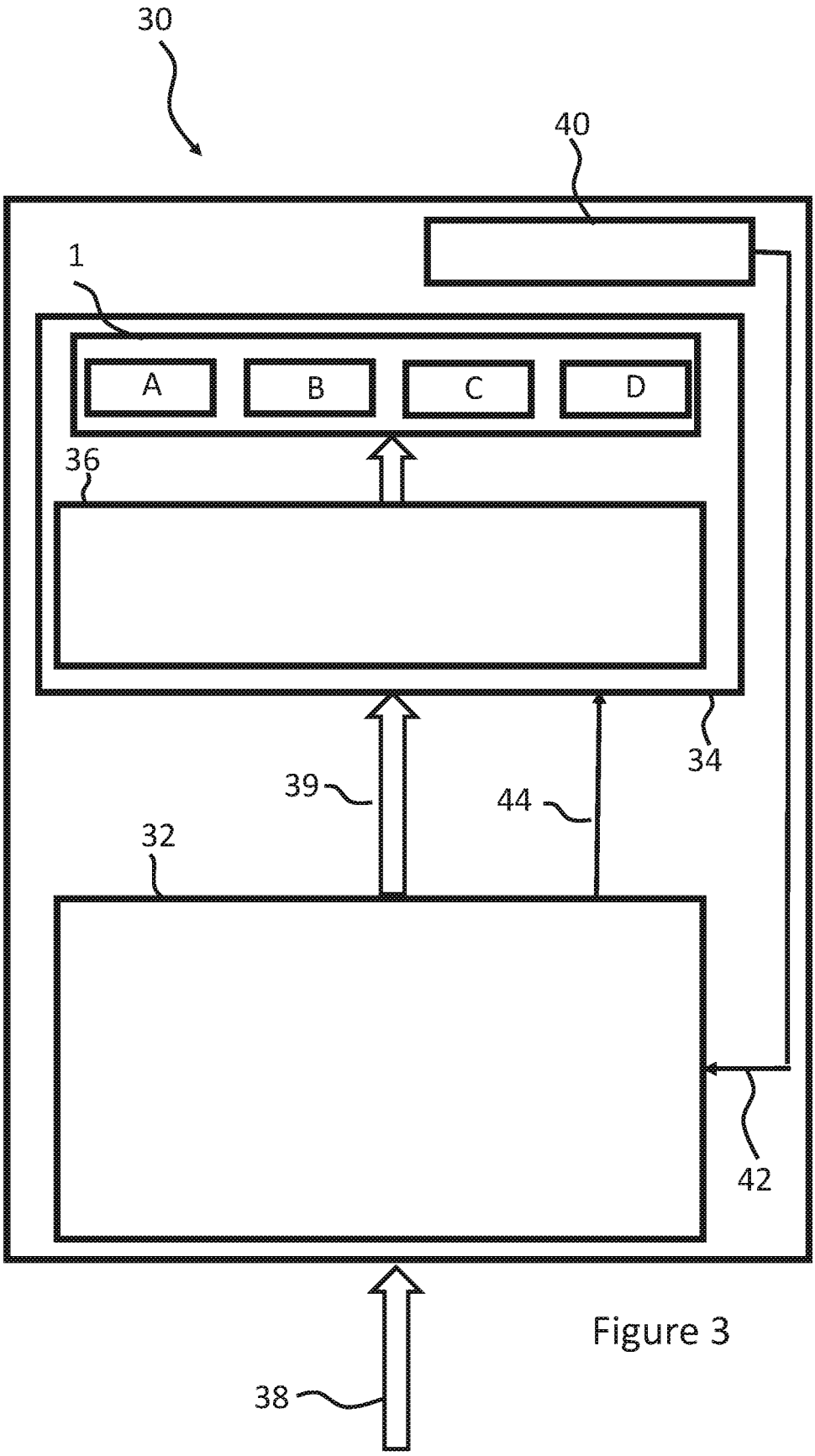
Figure 4A:
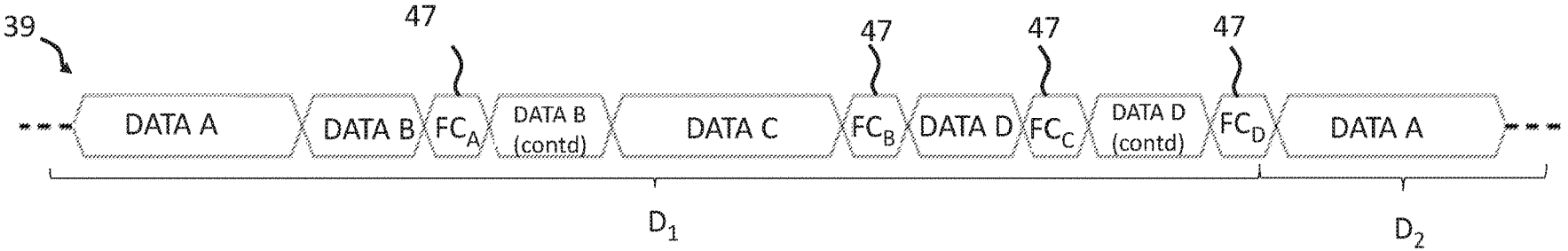
Figure 4B:
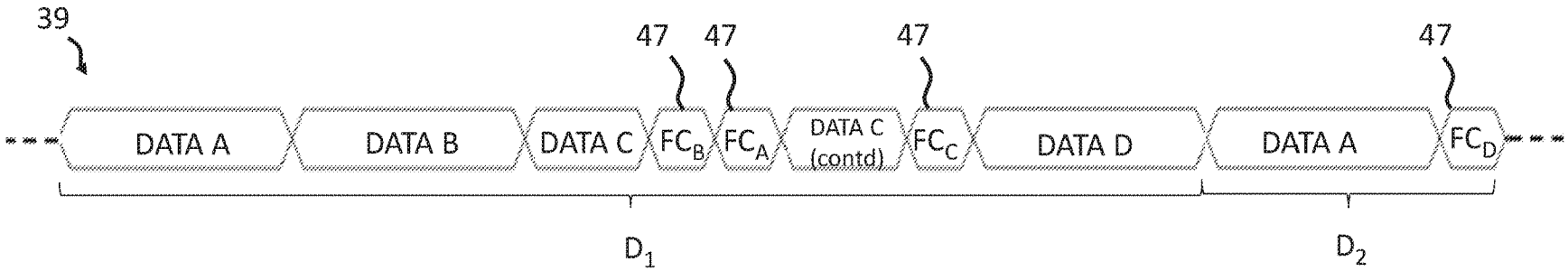
Figure 5:
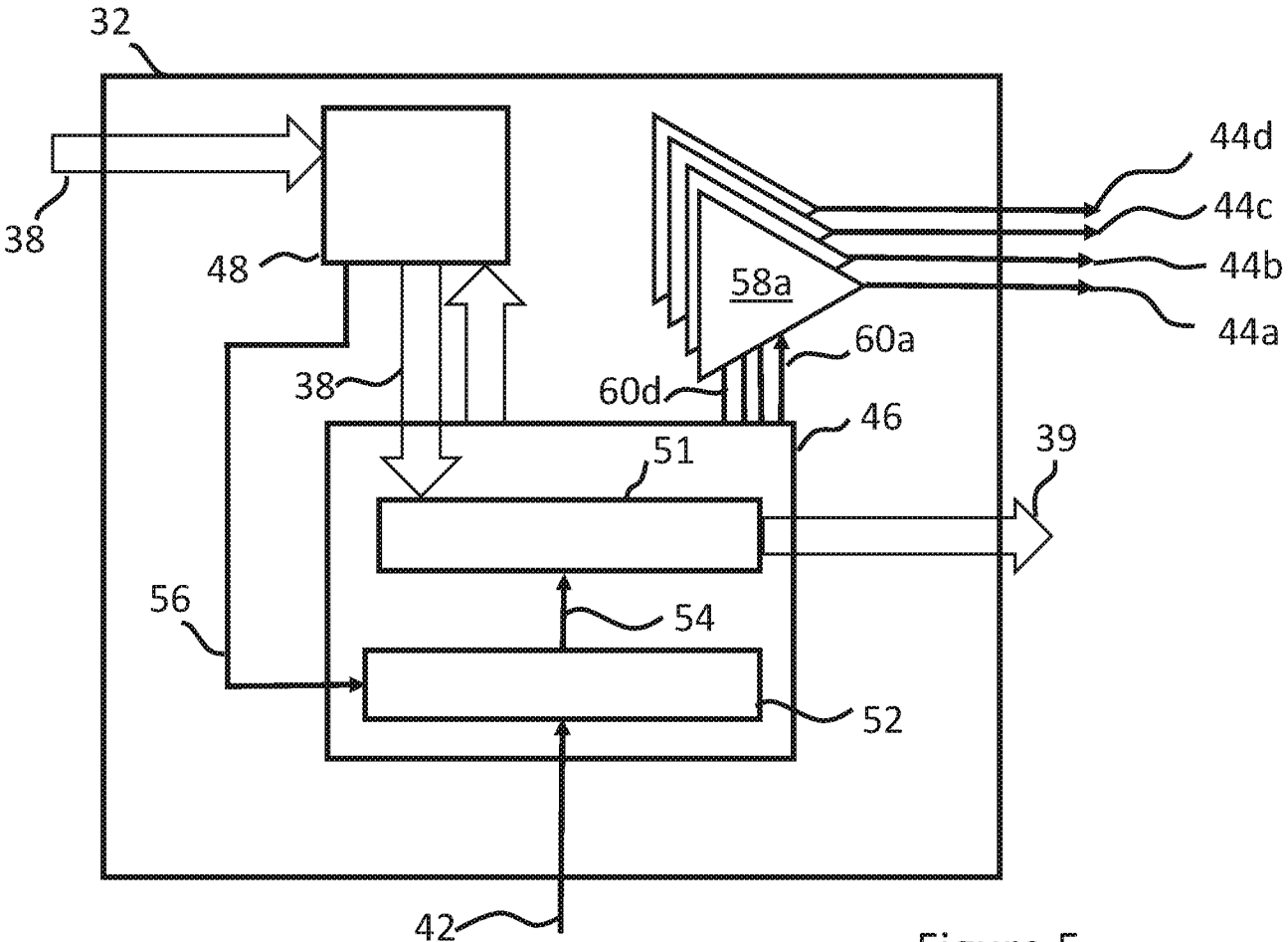
Figure 6:
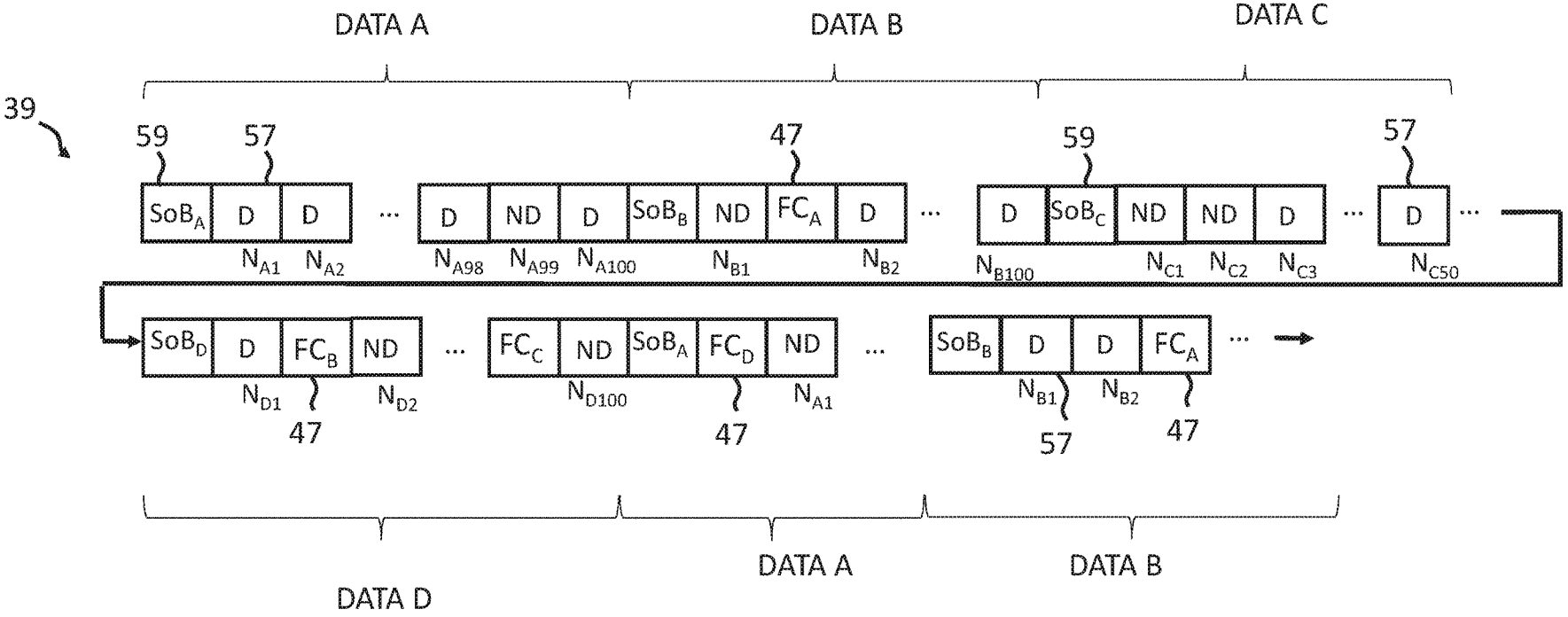
Figure 7B:
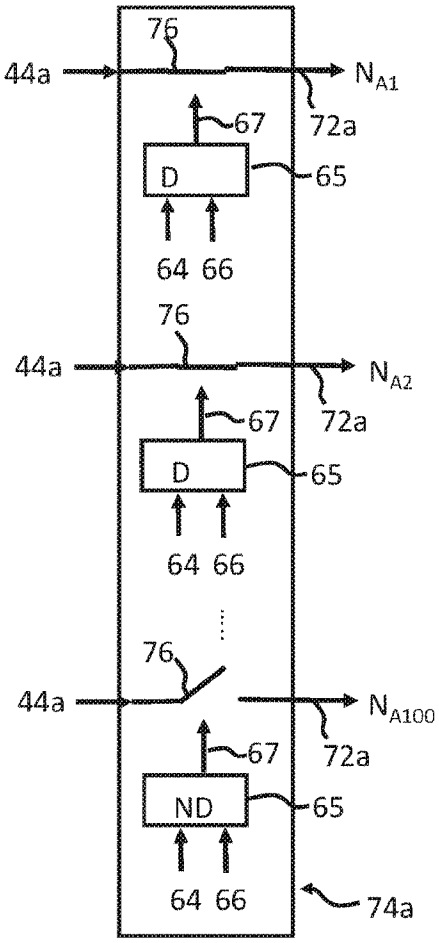
Figure 7A:
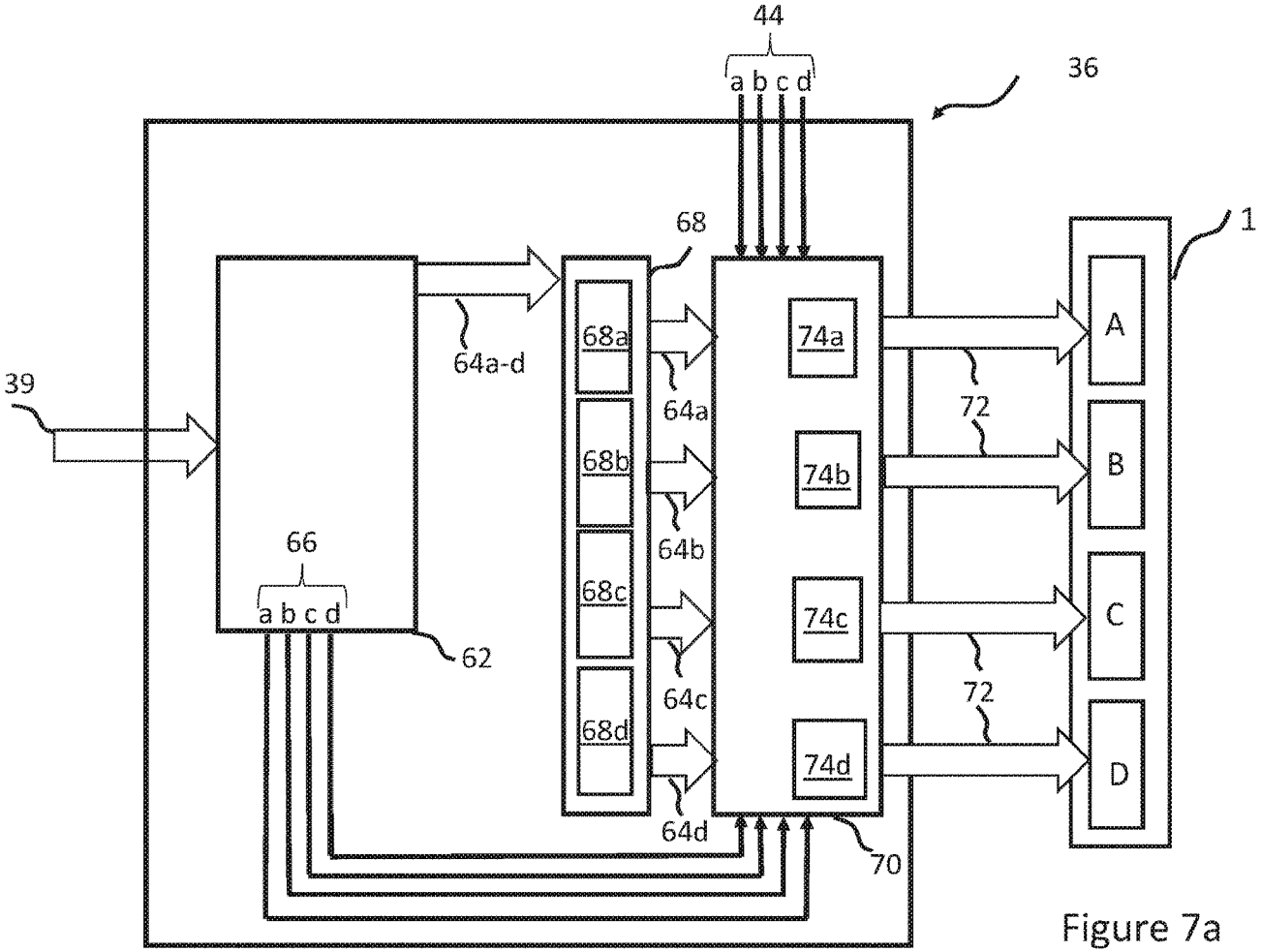

Embodiments will now be described with reference to the accompanying figures of which:

FIG. 1 schematically shows a cross section through part of an actuator of a known droplet deposition head;

FIGS. 2*a* & 2*b* schematically show different example configurations of nozzle arrays in the die of FIG. 1;

FIG. 2*c* schematically shows a line of dots created on a receiving medium when the nozzles of FIG. 2*b* are controlled without a time delay;

FIG. 2*d* schematically shows a line of dots created on a receiving medium when the nozzles of FIG. 2*b* are controlled with different waveforms;

FIG. 2*e* schematically shows an example configuration of nozzle arrays in the die of FIG. 1;

FIG. 3 schematically shows a droplet deposition apparatus comprising a controller and further comprises a droplet deposition head;

FIGS. 4*a* and 4*b* schematically show an example of a droplet deposition head data stream according to embodiments;

FIG. 5 schematically shows components of the controller of FIG. 3 in greater detail;

FIG. 6 schematically shows a droplet deposition head data stream in greater detail;

FIG. 7*a* schematically shows components of a droplet deposition head controller in greater detail;

FIG. 7*b* schematically shows switch logic of the droplet deposition head controller of FIG. 7*a;*

Figures 8A, 8B, 8C:
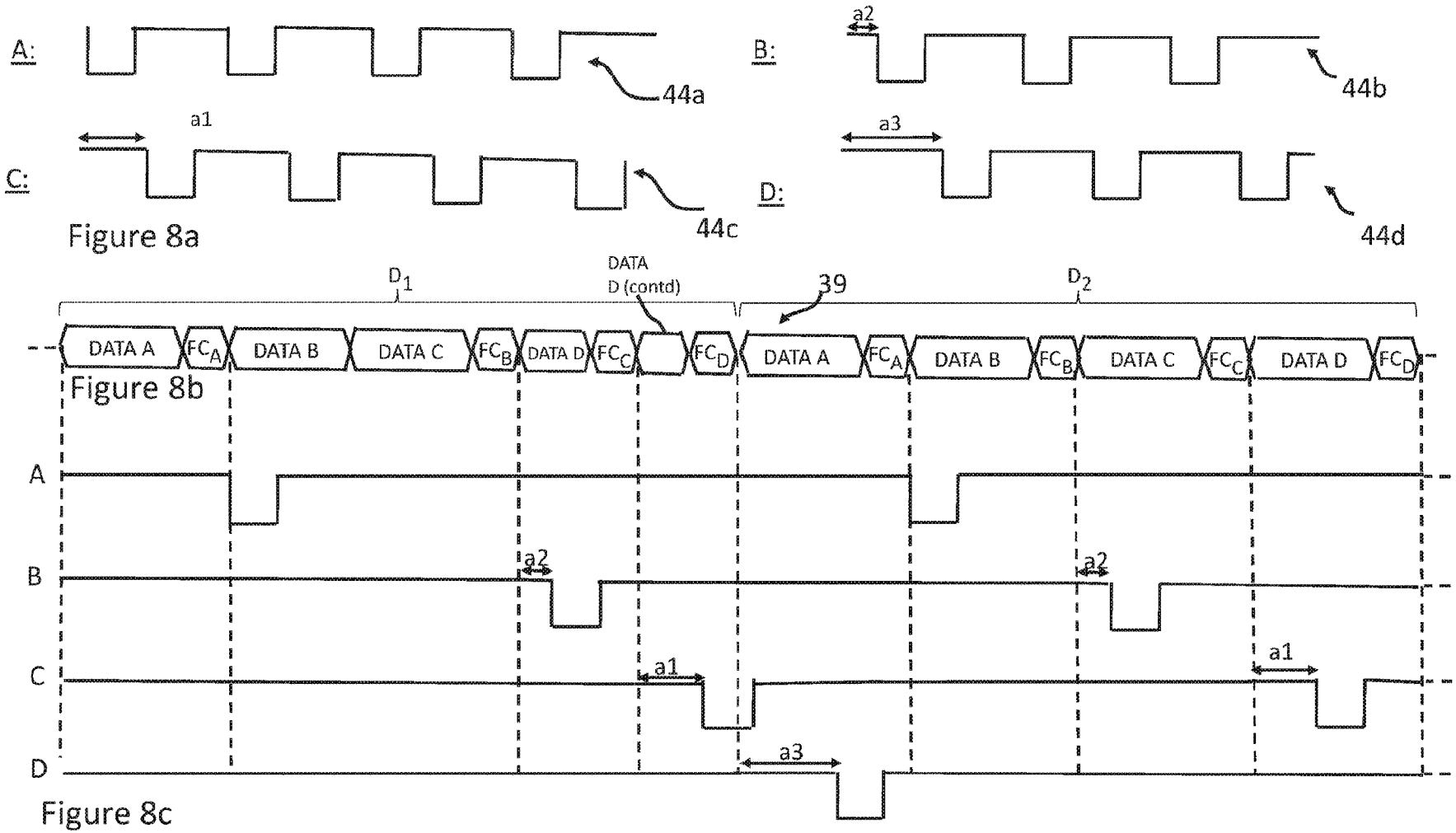

FIG. 8*a* schematically shows example drive waveforms according to an embodiment;

FIG. 8*b* schematically shows a droplet deposition head data stream according to an embodiment; and FIG. 8*c* schematically shows drive pulses generated in response to the decoded fire codes according to an embodiment.

The present invention will be described with respect to particular embodiments and with reference to figures but note that the invention is not limited to features described, but only by the claims. The figures described are only schematic and are non-limiting examples. In the figures, the size of some of the elements may be exaggerated and not drawn to scale for illustrative purposes.

FIG. 1 schematically shows a cross section of part of a known droplet deposition head, hereinafter "printhead". The printhead may be part of a known droplet deposition apparatus, hereinafter "printer".

In the present illustrative example, the droplet deposition head comprises a die 1, such as a silicon die, having at least one pressure chamber 2, the pressure chamber having a membrane 3 with an actuator element 4 provided thereon to effect movement of the membrane 3 between a first position (depicted as P1), here shown as a neutral position, inwards into the pressure chamber to a second position (depicted as P2). It will also be understood that the actuator element could also be arranged to deflect the membrane in a direction from P1 opposite to that of P2 (i.e. outwards of the pressure chamber).

The pressure chamber 2 comprises a fluidic inlet port 14 for receiving fluid from a reservoir 16 arranged in fluidic communication with the pressure chamber 2.

The pressure chamber 2 optionally comprises a fluidic outlet port 18 for recirculating any excess fluid in the pressure chamber 2 back to the reservoir 16 (or to another destination). In embodiments where the fluidic outlet port 18 is closed or no fluidic outlet port 18 is provided, then the fluidic inlet port 14 may merely replenish fluid that has been ejected from the pressure chamber 2 via nozzle 12. In embodiments, the fluidic inlet 14 and/or fluidic outlet port 18 may have a one-way valve.

The reservoir 16 is merely depicted adjacent the pressure chamber 2 for illustrative purposes. However, it may be provided further upstream, or remote from the printhead using a series of pumps/valves to regulate the flow of fluid therefrom/thereto as appropriate.

In the present examples, the actuator element 4 is a piezoelectric actuator element 4 whereby a piezoelectric material 6 is provided between a first electrode 8 and a second electrode 10 such that applying an electric field across the actuator element 4 causes the actuator element 4 to charge, such that it experiences a strain and deforms. It will be understood that the actuator element is not limited to being a piezoelectric actuator element, and any suitable actuator element 4 may be used as appropriate.

In the schematic example in FIG. 1, the pressure chamber 2 is arranged in what is commonly referred to as a "roof mode" configuration, whereby deflection of the membrane 3 changes the volume, and, therefore the pressure, within the pressure chamber 2. By applying a suitable deflection sequence to the membrane 3 such that sufficient positive pressure is generated within the pressure chamber 2 one or more droplets are ejected therefrom.

Such droplet ejection from nozzle 12 may be achieved by applying drive pulses in the form of a voltage waveform to associated actuator element 4 e.g. to the first electrode 8, whilst maintaining the bottom electrode 10 at a reference potential such as ground potential. By carefully designing the drive waveform, it is possible to achieve predictable and uniform droplet ejection from the nozzle 12.

In embodiments the droplet deposition head may comprise a plurality of nozzles arranged in one or more nozzle arrays thereon.

In embodiments, a common drive waveform comprising a sequence of one or more drive pulses may be selectively applied to plurality of actuator elements as a drive waveform for ejecting droplets from nozzles associated therewith.

Alternatively, a drive waveform comprising a sequence of drive pulses may be generated on a per actuator element basis. Such a drive waveform may be generated, for example, by circuitry on the printhead.

As will be understood by a person skilled in the art, the ejection of the droplets may be timed so as to accurately land on a receiving medium (in conjunction with regulating the motion of a receiving medium, where necessary) within predetermined areas defined as pixels.

These pixels are the desired position/location of the resulting dot on the receiving medium based on a rasterization of the image that is to be printed as derived from the print data.

In a simple binary representation, each pixel will be filled with either one or no droplet.

In a more complex representation, greyscale levels may be added by printing two or more droplets into each pixel to alter the perceived colour density of the resulting pixel. In this case, the droplets landing within the same pixel will generally be referred to as sub-droplets. Where ejected from the same nozzle, such sub-droplets may be ejected in rapid succession so as to merge before landing on the receiving medium as one droplet of a volume that is the sum of all sub-droplet volumes. Once landed on the receiving medium, the droplet will, in the following text, be referred to as a 'dot'; this dot will have a colour density defined by the droplet volume or the sum of all sub-droplet volumes. The drive pulses can therefore determine the greyscale level of a pixel.

The die 1, and the associated features thereof (e.g. nozzle (s), actuator element(s), membrane(s), fluid port(s) etc.) may be fabricated using any suitable fabrication processes or techniques, such as, micro-electrical-mechanical systems (MEMS) processes.

It will be understood that the techniques described herein are not limited to printheads operating in roof mode configurations and apply to printheads having other configurations, such as shared wall configurations.

Furthermore, whilst only one pressure chamber 2 is depicted in FIG. 1, it will be understood that any number of pressure chambers may be arranged in a suitable configuration(s) therein.

FIGS. 2*a*-2*e* schematically show example configurations of nozzle arrays.

In FIG. 2*a*, the nozzles 12 are provided in a nozzle array in a single row, with adjacent nozzles in the row separated by a pitch (P) along the length of the die 1.

In FIG. 2*b*, the nozzles 12 are provided in a nozzle array, in two rows (R1, R2) in a non-staggered configuration relative to each other. Adjacent nozzles in the same row are separated by a pitch (P) along the length of the die 1 and adjacent rows are separated by a spacing (S) along the width of the die 1.

FIG. 2*c* schematically shows two lines 22 and 24 created on a receiving medium when all actuating elements of the nozzles of FIG. 2*b* are driven at the same time. FIG. 2*d* schematically shows a line created on a receiving medium when the nozzles of each row R1 and R2 of FIG. 2*b* are caused to eject droplets with a suitable time delay between R1 and R2.

In FIG. 2*e*, the nozzles 12 are provided in a nozzle array, in two rows (R1, R2) in a staggered configuration relative to each other. As above, adjacent nozzles in the same row are separated by a pitch (P) along the length of the die 1 and adjacent rows are separated by a spacing (S) along the width of the die 1.

It will be noted that the pitch (P) may vary along the length of the die e.g. when the nozzles towards the end of each row are separated by a pitch greater than P or less than P.

In some examples crosstalk (e.g. fluidic/mechanical/electrical) may occur when driving adjacent actuating elements, or actuating elements in close proximity, at substantially the same time, depending on the common fluid, mechanical or electrical path. Crosstalk may adversely affect the characteristics of droplets, thereby impacting the achievable print quality or the efficiency of the printer.

Fluidic crosstalk may result from pressure waves between neighbouring pressure chambers, mechanical crosstalk may be the result of insufficient stiffness of separating elements between pressure chambers (chamber walls, plenum walls); whilst electrical crosstalk may result from sharing electrical tracks between neighbouring actuator elements.

However, grouping nozzles is advantageous when driving actuating elements on the same die so as to mitigate the impact of crosstalk. For example, the nozzles on each die 1 may be grouped together (e.g. in groups A, B, C, D, . . . etc.), such that one or more nozzles of a first group (e.g. group A) may eject droplets as a result of a first waveform, whilst one or more nozzles of a second group (e.g. group B) eject droplets as a result of using a different waveform. In the present examples, a different waveform includes the first waveform following a temporal offset or delay (t).

Taking the die 1 of FIG. 2*a* as an illustrative example, if all nozzles in row R1 eject droplets without any timing regulation, then there may be occurrences of fluidic crosstalk due to pressure waves from one pressure chamber affecting neighbouring pressure chambers constructively or destructively, leading to a degradation in print quality.

There may also be occurrences of electrical crosstalk in the electrical wiring on the die 1 due to currents being drawn due to adjacent actuator elements charging/discharging at the same time, whilst there may be occurrences of mechanical crosstalk for example through the chamber walls of adjacent pressure chambers.

Therefore, grouping adjacent nozzles in the same row in different groups (e.g. A & B in FIG. 2*a*), and ejecting droplets from the nozzles in the different groups with different waveforms (e.g. different timings) reduces one or more of the different types of crosstalk, whilst achieving desired features on a receiving medium.

Grouping nozzles may also be advantageous when ejecting droplets from nozzles in different rows.

Taking the die 1 of FIG. 2*b* as an illustrative example, if all nozzles in both rows (R1 & R2) were to eject droplets at the same time, then crosstalk may occur, whilst the resulting droplets would land in different pixel rows on a receiving medium travelling at a constant velocity relative to the die 1 (e.g. in the direction as indicated by the arrow 20).

Specifically, and as schematically illustrated in FIG. 2*c*, when all nozzles in the die 1 eject droplets at the same time, the droplets ejected from the nozzles of group A would form a first line 22 on the receiving medium and the droplets ejected from the nozzles of group B would form a second line 24 on the receiving medium, wherein the first line 22 is separated from the second line 24 by a distance substantially equal to the spacing (S).

However, and as schematically illustrated in FIG. 2*d*, by ejecting droplets from the nozzles of group A, and ejecting droplets from the nozzles of group B with a different timing (e.g. the same first waveform following a delay (t)), then droplets ejected from the two groups of nozzles would form a substantially continuous line 26 across the receiving medium (dependent on the waveform and the delay (t)).

Similarly, taking FIG. 2*e* as a further example, by ejecting droplets from the nozzles of groups A and C with first and second waveforms respectively, and ejecting droplets from the nozzles of groups B and D with third and fourth waveforms respectively, then droplets ejected from the different groups of nozzles A, B, C and D may generate a desired dot pattern on the receiving medium, whilst reducing crosstalk.

Therefore, and as depicted in the illustrative examples, by grouping the nozzles and ejecting droplets from nozzles in different groups with different waveforms, droplet ejection may be controlled to generate desired features, whilst reducing electrical, mechanical and/or fluidic crosstalk.

In order to generate the different waveforms and eject droplets from the nozzles at the correct timings, the printer comprises various hardware and software components.

As a schematic example, FIG. 3 shows a printer 30 which comprises a printer controller 32 and further comprises a printhead 34 according to an embodiment. Like reference numerals used previously will be used to describe identical or similar features as appropriate.

The printhead 34 comprises a printhead controller 36 and a die 1, the die 1 having one or more pressure chambers (not shown) with associated features (e.g. nozzle, actuators element etc.) as previously described.

The printer controller 32 comprises hardware and software components configured to regulate the functionality of the printer 30.

The printer controller 32 includes communication circuitry (not shown) for transmitting/receiving communications to/from one or more internal/external sources, such as a host computer (not shown), printhead 34 and/or a media encoder 40.

For example, the communication circuitry may comprise an external and or internal interface unit for receiving print data transmitted from the host computer and may include a serial interface such as USB (Universal Serial Bus), IEEE1394, Ethernet, wireless network, or a parallel interface.

The communication circuitry may comprise an internal interface unit for transmitting data between the printer controller 32 and printhead controller 36, and may include a serial interface such as USB (Universal Serial Bus), IEEE1394, Ethernet, wireless network, or a parallel interface.

In the present example, print data 38 is transmitted to the printer controller 32, whereby the print data 38 relates to the desired characteristics of a dot to be created on a receiving medium (e.g. position, density, colour etc.). As such the print data 38 may define the characteristics of the droplets required to be ejected from a particular nozzle in order to fill a pixel and create a dot on a receiving medium or, as the case may be, to not fill a pixel with no droplet being ejected.

The printer controller 32 processes the print data 38 and generates a printhead data stream 39 in response thereto, whereby the printhead data stream 39 comprises instruction code for different groups of nozzles of the printhead 34, and, in particular, instruction code denoting a specific function/instruction for nozzles designated in a particular group, e.g. indicating how the individual nozzles of the particular group should be controlled to fill the respective pixels (i.e. to eject one or more droplets or to not eject droplets as the case may be).

The printhead data stream 39 also comprises instruction code indicating when a particular group should be "fired" i.e. indicating when the actuating elements associated with the nozzles designated in the particular group should be driven or not driven so as to control the nozzles as appropriate.

In the present illustrative example four groups of nozzles (A-D) are depicted in the printhead 34 e.g. arranged in one or more rows. However, any number of groups may be used.

The printhead data stream 39 is transmitted to the printhead controller 36, and processed by circuitry thereat.

In the present embodiments, the instruction code indicating when a group should be fired is included in the printhead data stream 39 as a reserved code or data packet(s), hereinafter "fire code", whereby the fire code is identified by the printhead controller 36 as a timing signal for firing an associated group. The fire code is generated independently of the instruction code denoting a specific function/instruction for nozzles.

In embodiments, media encoder 40 is provided in communication with the printer controller 32, whereby the media encoder 40 generates data relating to characteristics of a receiving medium (not shown) onto which droplets are to be ejected. Such data may relate to the velocity/acceleration of the receiving medium moving relative to the printhead 34 or to the velocity/acceleration of the printhead 34 moving relative to the receiving medium. The media encoder 40 transmits the data as an input, hereinafter 'ME input' 42, to the printer controller 32.

The printer controller 32 processes the ME input 42 to determine at what point in time a group of nozzles should be fired in order to accurately fill pixels on the receiving medium.

As an illustrative example, the media encoder 40 may provide an ME input every (T) based on the relative movement between the printhead 34 and receiving medium. If the velocity of the receiving medium changes (e.g. slows down to give e.g. (T+δμm) or speeds up to give (T−δμm)) the media encoder 40 will update the ME input accordingly.

The printer controller 32 also transmits waveform data 44 to the printhead controller 36. In some embodiments, the waveform data 44 may comprise one or more drive waveforms, whereby each drive waveform may be applied as drive pulses to drive the actuating elements associated with the nozzles of a particular group.

In alternative embodiments, the waveform data 44 may comprise signals which the printhead controller 36 processes to generate drive pulses on a per actuator element, or per group, basis.

FIGS. 4*a* and 4*b* illustratively show an example printhead data stream 39 according to an embodiment, whereby the printhead data stream 39 comprises data blocks for the different groups of nozzles, whereby a data block comprises instruction code in the form of drive data denoting how the individual nozzles of a particular group should be controlled during a droplet period $D_i$ (shown as ($D_i$), where 'i' is an integer and denotes a specific droplet period for which the nozzles are to be controlled).

In FIGS. 4*a* and 4*b*, the data blocks are shown as 'DATA x' (where 'x' denotes a particular group), and in the present illustrative example, DATA A comprises drive data for Group A; DATA B comprises drive data for Group B; DATA C comprises drive data for Group C; and DATA D comprises drive data for Group D. As above, there may be more or fewer than four groups.

In FIGS. 4*a* and 4*b*, fire codes 47 (depicted as ($FC_x$), where 'x' denotes the particular group), are also depicted as being included in the printhead data stream 39.

In the present illustrative example, $FC_A$ indicates when Group A should be fired for droplet period $D_1$; $FC_B$ indicates when Group B should be fired for $D_1$; $FC_C$ indicates when Group C should be fired for $D_1$; and $FC_D$ indicates when Group D should be fired for $D_1$.

As above, the fire code for a particular group is generated independent of the data blocks comprising the instruction code, whereby, for example, the fire codes are generated independent of the data blocks for the respective groups and independent of the data blocks for other groups in the printhead data stream 39, such that fire codes can be inserted anywhere within the printhead data stream.

For example, where a data block (DATA x) for a particular group and a fire code $FC_x$ for that particular group are provided in the printhead data stream, the fire code $FC_x$ may directly follow the data block for that particular group.

As a further example, rather than directly or immediately following the data block (DATA x), the fire code $FC_x$ may be positioned elsewhere in the printhead data stream 39 (i.e. indirectly follow the data block for that particular group). For example, the fire code $FC_x$ may be inserted in the printhead data stream 39 so as to interrupt a subsequent data block (DATA x+1), or it may be inserted in the printhead data stream 39 between two subsequent data blocks for different groups (e.g. between DATA x+1 and DATA x+2).

Taking FIG. 4*a* as an illustrative example, $FC_A$ indirectly follows DATA A by being inserted so as to interrupt DATA B; $FC_B$ indirectly follows DATA B by being inserted between DATA C and DATA D; $FC_C$ indirectly follows DATA C by being inserted so as to interrupt DATA D, whilst $FC_D$ immediately follows DATA D.

There is no requirement for the fire codes ($FC_x$) of the different groups to be in sequential order. Taking FIG. 4*b* as an illustrative example, $FC_B$ precedes $FC_A$.

It will be seen that the ability to insert fire codes anywhere within the printhead data stream, and within data blocks, negates the need for the printer controller to complete generating a data block before inserting the fire code into the printhead data stream. Generation of the data block may be interrupted to insert a fire code in the printhead data stream and resumed thereafter. The information required to complete the data block may be stored in a buffer until insertion of the fire code is complete.

As any delay in waiting for the data block to complete before inserting the fire code is minimised or negated, the printhead data stream can be transmitted to the printhead controller faster in comparison to having to wait for a data block to complete, such that the timing accuracy for firing the groups can be increased. Therefore, the droplet deposition head may print with an increased drop placement accuracy, for example even when accelerating or decelerating relative to the receiving medium. Such functionality is advantageous as the print speed increases.

Furthermore, providing fire codes for the different groups means the different groups can be fired independently of each other, and therefore the respective nozzles of one group may be controlled independently of nozzles in a different group. As above, controlling nozzles of the different groups with carefully chosen time delays (where such groups may share part of the fluid, mechanical or electrical path and are liable to interfere with one another if fired at the same time) provides for a reduction in crosstalk, which in turn provides for improvements in print quality.

Furthermore, whilst FIGS. 4*a* and 4*b* depict the data blocks and fire codes as having a 1:1 mapping per droplet period i.e. whereby a fire code ($FC_x$) is generated every time a data block (DATA x) is generated, this is not always the case. In some embodiments a data block (DATA x) will not be generated for every droplet period $D_{1-i}$ nor will a fire code ($FC_x$) be generated for every droplet period $D_{1-i}$.

In some embodiments one data block may be generated for a particular group of nozzles for a first droplet period $D_1$, whilst a plurality of fire codes may be provided for the particular group for the first droplet period $D_1$ and/or for one or more subsequent droplet periods $D_2$-$D_i$.

FIG. 5 schematically shows components of the printer controller 32 in greater detail. Like reference numerals used previously will be used to describe identical or similar features as appropriate.

The printhead controller 32 comprises processing circuitry 46, configured to process data (e.g. print data 38, ME input 42, operational data 56, programs or instructions etc.) and to generate output signals in response to the processed data.

The processing circuitry 46 may, for example, comprise a field programmable gate array (FPGA), system on chip (SoC) device, microprocessor device, microcontroller or one or more integrated circuits.

In the present illustrative embodiment, the printhead controller 32 also comprises storage circuitry 48 for storing data. The storage circuitry 48 may comprise volatile memory such as random access memory (RAM), for use as temporary memory whilst the printhead controller 32 is in an operational state.

Additionally, or alternatively, the storage circuitry 48 may comprise non-volatile memory such as flash, read only memory (ROM) or electrically erasable programmable ROM (EEPROM), for storing data whilst the printhead controller 32 is in an operational or non-operational state (e.g. powered down or power saving state). For example, operational data, programs or instructions may be stored in the non-volatile memory.

In the present embodiment, print data 38 is received at the printer controller 32, and may be stored in a buffer (not shown) in the storage circuitry 48 whilst awaiting processing.

The processing circuitry 46 comprises print data encoder circuitry 51, hereinafter 'PDE circuitry' 51. The PDE circuitry 51 generates encoded drive data based on or in response to processing the print data 38 (e.g. from a buffer), whereby the encoded drive data is included in the printhead data stream 39.

The encoded drive data may be created using any suitable encoding scheme (e.g. 4b/5b, 4b/6b encoding, 6b/8b encoding, 8b/10b encoding, 64b/66b encoding, Eight-to-fourteen modulation etc.)

The processing circuitry 46 further comprises media encoder circuitry 52, hereinafter 'ME circuitry', which processes the ME input 42 and generates a media signal 54 in response thereto.

The ME circuitry 52 may also generate the media signal 54 in response to additional data, such as operational data 56 relating to the desired operation of the printer (e.g. desired resolution (e.g. 1200 dpi), desired frequency (e.g. 70 kHz)—it will be understood these figures are for illustrative purposes only).

In the present example, the media signal 54 is used by the PDE circuitry 51 to determine when a fire code ($FC_x$) for a particular group should be included in the printhead data stream 39 such that a corresponding group can be fired at the correct time during a specific droplet period.

A schematic example of the printhead data stream 39 is depicted in FIG. 6. As above, the printhead data stream 39 comprises data blocks (DATA A-DATA D) provided for the groups of nozzles on the die, each data block having encoded drive data denoting how the individual nozzles of a particular group should be controlled.

In the present illustrative example, the encoded drive data comprises a plurality of data packets 57 each comprising an m-bit code (where m is an integer), which in the present example, is a drive code symbol to indicate how a particular nozzle should be controlled.

For example, when using an 8b/10b encoding scheme, the data packets 57 comprise 10-bit drive code symbols mapped from 8-bit code symbols based on or responsive to the print data. As above, alternative encoding schemes may also be used.

In the present illustrative example, the drive code symbols comprise (D) and (ND), whereby a (D) symbol indicates that one or more droplets should be ejected from a particular nozzle, whilst an (ND) symbol indicates that a droplet should not be ejected from a particular nozzle.

In examples, each data packet 57 is associated with a particular nozzle, as indicated by $N_{XL}$ in FIG. 6, (where, as above, 'x' denotes the particular group & where L is an integer, indicative of the nozzle's position/designation within the group).

In alternative examples, the drive code symbols included in the data packets 57 may also comprise an identifier for the nozzle indicative of the nozzle's position/designation within the group.

In the illustrative example of FIG. 6, and for the purposes of simplicity, 100 nozzles are designated in each group. However, groups may comprise any number of nozzles, and different groups may have different numbers of nozzles designated therein.

In the present example the printhead data stream 39 further comprises reserved code or data packets having k-bit control symbols (where 'k' is an integer) which designate or denote a defined instruction e.g. fire code ($FC_x$) 47, start of data block ($SoB_x$) 59, or end of data block (not shown). Furthermore, in the context of the present description, a reserved code comprises a unique code in the data stream.

As above, the k-bit control symbols may be inserted in the printhead data stream 39 by the PDE circuitry when required.

For example, the fire code ($FC_x$) control symbols may be inserted within the printhead data stream 39 in response to the media signal 54.

In examples, the k-bit control symbols are encoded using the same encoding scheme used to encode the drive code symbols.

As above, the ability to insert fire codes into the printhead data stream independently of the drive data provides for increased print speeds and/or higher image quality because there is no requirement for the printer controller to wait until a data block is completed before inserting the fire code in the printhead data stream and, therefore, the delay between generating the fire code and transmitting it to the printhead controller is minimised.

With respect to FIG. 5, and as previously described, the printer controller 32 transmits the printhead data stream 39 to the printhead controller using any suitable communications protocol and/or signalling standard e.g. 8b/10b encoding on low voltage differential signalling (LVDS), a serial communications protocol, etc.

Although not specifically depicted, it will be understood by a skilled person that a clock signal may be transmitted to printhead controller 36 for use in the decoding process. For example, an LVDS clock signal may be transmitted to the printhead controller 36 alongside the printhead data stream 39 or the clock signal (e.g. digital clock signal) may be recovered from the printhead data stream 39.

The printhead data stream 39 comprising the data blocks and fire codes may be transmitted along a single communications channel, which, depending on the protocol and/or standard used, may comprise a single conductor or pair of conductors (e.g. wires, pins). However, any suitable communications channel may be provided.

The printer controller 32 also transmits waveform data 44 to the printhead controller 36 using any suitable communications protocol and/or signalling standard.

Whilst not depicted in FIG. 6, it will be appreciated that 'idle' symbols, indicating zero data, may also be included in the data stream to provide spacing between data blocks and/or fire codes.

In the illustrative example of FIG. 5, the waveform data 44 comprises a common drive waveform for each group, whereby, as depicted, the printer controller 32 comprises four waveform generators 58*a*-58*d*, each configured to generate a common drive waveform in response to a waveform control signal 60*a*-60*d*.

Each waveform control signal 60*a*-60*d* comprises a logic output which is fed to a respective digital-to-analog converter (DAC) (not shown), whereby an analog output from the DAC may be used as an input to an amplifier for generating the respective common drive waveform 44*a*-44*d*.

FIG. 7*a* schematically shows components of the printhead controller 36 in greater detail. Like reference numerals used previously will be used to describe identical or similar features as appropriate.

The printhead controller 36 comprises various hardware & software components for communicating with the printer controller (not shown in FIG. 7*a*) and driving the actuating elements to control nozzles associated therewith in an appropriate manner.

In embodiments, the printhead controller 36 may comprise one or more application specific integrated circuits (ASIC) or other suitable hardware/software components.

In the present example the printhead controller 36 comprises decoder circuitry 62, which receives the printhead data steam 39 from the printer controller (not shown in FIG. 7*a*), decodes the printhead data stream 39, and generates one or more outputs for controlling the nozzles of the respective groups.

In the illustrative example, one output is nozzle data stream 64*a*-*d*, which comprises decoded drive data, whereby the nozzle data stream 64*a*-*d* may define how each nozzle of a particular group is to be controlled.

A further output is fire signal 66, which, in the present example, is illustratively depicted as a different fire signal for each respective group A-D.

In operation, the decoder circuitry 62 decodes the printhead data stream 39 in accordance with the scheme used to generate the encoded print data as previously described and outputs the nozzle data stream 64*a*-*d* and fire signal 66*a*-*d* accordingly.

The printhead controller 36 further comprises storage circuitry 68, which, in the present example, comprises four shift register arrays 68*a*-68*d*, each array having one or more registers arranged to temporarily store data packets of the nozzle data stream 64 for one of the respective groups (A-D).

In embodiments the data packets in the nozzle data stream 64 are loaded into the appropriate shift register arrays e.g. whereby, for example, the $SoB_x$ control code in a decoded data block defines the appropriate shift register array into which the next L decoded data packets following the $SoB_x$ are loaded, whilst the specific positioning of the data packet following the $SoB_x$ may define the particular shift register in the register array into which that packet is loaded into.

In alternative examples the drive code symbol in a particular data packet may define the specific register in the register array into which that particular data packet is loaded, as identified by, for example, the decoder circuitry 62.

The printhead controller 36 further comprises switch logic 70 for switching the waveform data 44*a*-44*d* onto the nozzles of the different groups (A-D) in response to the drive code symbols in the different packets and the fire signal 66.

As illustratively shown in FIG. 7*a*, the switch logic 70 may comprise an array of switches 74*a*-*d* for the respective groups (A-D), each switch 76 in an array 74*a*-*d* associated with a particular shift register and a particular nozzle, and the state of which is controlled (open/closed) by a switch controller 65 which may comprise any suitable logic or component.

On decoding the printhead data stream 39 and identifying a fire code $FC_x$ for a particular group (A-D), the decoder circuitry 62 outputs a fire signal 66 for the particular group (A-D), whereby the decoded data packets are output from the corresponding shift registers and used as inputs 64 to switch controller 65 along with fire signal 66, whereby an output 67 from switch controller 65 is used to control the state of an associated switch 76 in accordance with drive code symbols in the decoded drive data for that particular nozzle.

In an illustrative example of FIG. 7*b*, when the switch controller 65 receives a data packet comprising a D symbol and a fire signal 66, the switch controller 65 closes the switch 76 such that the waveform data 44 is applied as a drive pulse 72 to the actuator element of the associated nozzle. Therefore, the nozzle will fill a pixel with ejected droplets in accordance with the applied drive pulses for that droplet period. This is shown for Nozzles $N_{A1}$ and $N_{A2}$ in FIG. 7*b*.

Meanwhile, when the switch controller 65 receives a data packet comprising an ND symbol and a fire signal, the switch controller 65 opens the switch 76 such that no drive pulse is applied to the actuator element of the associated nozzle. Therefore, no droplet will be ejected from that nozzle for that droplet period. This is depicted for Nozzle $N_{A100}$ in FIG. 7*b*.

Ejection of droplets from nozzles $N_{A3}$-$N_{A99}$ for the droplet period may be controlled by the switch controller 65 dependent on the respective decoded drive data and fire signal in the same manner as described above for $N_{A1}$, $N_{A2}$ & $N_{A100}$.

In embodiments, the switches 76 may comprise one or more transistors arranged in a suitable configuration, such as a pass gate configuration.

As described above, there is no requirement for the data blocks to have a 1:1 mapping with the fire codes, whereby, in embodiments, when the data packets of the respective data blocks are loaded into the appropriate shift register arrays, those data packets may be retained within the shift registers for two or more droplet periods, such that, when a fire code is identified, the nozzles of a particular group may be controlled in response to data packets previously loaded in the shift registers.

Therefore, when nozzles are to be controlled with the same data packets over two or more droplet periods, the PDE circuitry (not shown in FIG. 7*a*) is not required to encode new print data into the printhead data stream 39 for each droplet period and the PDE is only required to generate fire codes corresponding to when the groups should be fired.

It will be appreciated that, using such functionality, processing efficiency may be increased both at the printer controller and printhead controller in comparison to repeatedly encoding the same print data for the one or more droplet periods. The amount of data in the printhead data stream 39 may also be reduced, and, therefore, reduces the burden placed on the communications channel bandwidth in high resolution applications.

It will also be understood that idle symbols may be provided between the fire codes so as to provide spacing in the encoded printhead data stream (e.g. between fire codes), whereby the idle symbols do not cause the data packets to be overwritten in the registers.

FIG. 8*a* schematically shows example drive waveforms (A-D) 44*a*-44*d*, FIG. 8*b* schematically shows a printhead data stream 39, whilst FIG. 8*c* schematically shows the waveforms (A-D) as they would be applied to the different nozzles $N_{XL}$ over two droplet periods $D_1$ and $D_2$ in response to printhead data stream 39 when decoded at the printhead controller.

As will be appreciated, the nozzles $N_{XL}$ for a particular group will be controlled with the waveforms (A-D) in response to the drive code symbols (e.g. D & ND) in the drive data, at a time as defined by the decoded fire codes $FC_A$-$FC_D$.

Taking the die of FIG. 2*e* as an illustrative example, waveforms A & C are used to drive actuator elements of adjacent nozzles on the same row (R1), whilst waveforms B & D are used to drive actuator elements of adjacent nozzles on the same row (R2).

As illustratively shown, waveforms A-D are similar to each other but a different delay (a1-a3) is provided between the respective waveforms. It will be appreciated that the waveforms and delays depicted in FIG. 8*a* are illustrative only, and any waveform and/or delay may be provided for a particular group for any droplet period.

For example, the specific delay between waveforms for ejecting droplets from nozzles in different rows (e.g. (A & B) or (C & D)) may be selected based on or responsive to different factors, such as: the velocity of the receiving medium relative to the printhead, and/or the operational frequency of the printhead.

Furthermore, the specific delay between the waveforms for ejecting droplets from nozzles in the same row (e.g. (A & C) or (B & D)) may be selected to minimise the crosstalk between adjacent nozzles, which, as above, may affect the specific placement and/or quality of droplets on the receiving medium. This specific delay may be adjusted to account for variations in the speed of the receiving medium to provide for correct placement of droplets from nozzles in the same row of the receiving medium.

As above, there is no specific requirement for the fire code to be in a fixed order or fixed position within the data stream, and it is possible to insert fire codes into the printhead data stream without having to wait for a particular data block to complete before insertion therein.

The ability to insert fire codes into the printhead data stream before a particular data block completes provides for increased print speeds in comparison to having to wait for a data block to complete until inserting a fire code. Such functionality becomes increasingly advantageous as the print frequency (i.e. the speed of printing) increases.

Furthermore, as the fire codes are associated with respective groups of nozzles, and the groups can be defined to designate one or more nozzles in one or more rows, it is possible to control ejection of droplets from single or multiple rows of nozzles as appropriate dependent on the specific application.

It will be appreciated that it is possible to adjust the timing for the different groups to reduce crosstalk (e.g. mechanical, fluidic, electrical), and such reduction in crosstalk provides for improved drop placement accuracy and improved print quality.

Furthermore, as the waveforms A-D can be selectively applied to the respective groups, and the nozzles of the respective groups can be controlled by the switch logic over consecutive droplet periods, it is possible to fill pixels with the appropriate amount of droplets over one or more droplet periods as required by the print data.

Whilst the illustrative examples above describe the waveform data as a plurality of common drive waveforms generated at the printer controller, it will be understood that the common drive waveforms may alternatively be generated at the printer controller, printhead controller or may be generated remote from the printer itself.

Furthermore, there is no requirement for the waveform data to comprise a waveform common to all nozzles of a particular group, but instead the waveform data may comprise a waveform generated on a per-nozzle basis at the printer controller, printhead controller or remote from the printer itself.

Furthermore, the waveforms are not limited to the shape depicted in FIG. 8*a*, and any suitable shapes may be used as drive pulses. For example, a trapezoidal or sinusoidal drive pulse may be used.

Furthermore, characteristics of the drive pulses may be changed as appropriate depending on a particular application. Such characteristics include but are not limited to: amplitude, pulse width, slew rates etc. Furthermore, in embodiments the firing pulse may be followed by one or more non-ejecting pulses (not shown) which are used to generate pressure waves which interfere with the pressure waves caused by the firing pulse.

Furthermore, as above, whilst the printhead data stream of FIG. 8*a* depicts a 1:1 mapping between data blocks and fire codes per droplet period $D_i$, there is no requirement for the data stream to comprise such 1:1 mapping.

Furthermore, although not depicted in FIG. 8*b*, the printhead data stream may comprise idle symbols therewithin.

Where the term "comprising" is used in the present description and claims, it does not exclude other elements or steps and should not be interpreted as being restricted to the means listed thereafter. Where an indefinite or definite article is used when referring to a singular noun e.g. "a" or "an", "the", this includes a plural of that noun unless something else is specifically stated.

Furthermore, the present techniques may be realized in the form of a data carrier having functional data thereon, said functional data comprising functional computer data structures to, when loaded into a computer system or network and operated upon thereby, enable said computer system to perform all the steps of the method.

Furthermore, it will be understood that whilst various concepts are described above with reference to an inkjet printhead, such concepts are not limited to inkjet printheads, but may be applied more broadly in printheads, or more broadly still in droplet deposition heads, for any suitable application. As noted above, droplet deposition heads suitable for such alternative applications may be generally similar in construction to printheads, with some adaptations made to handle the specific fluid in question. The preceding description should therefore be understood as providing non-limiting examples of applications in which such a droplet deposition head may be used.

A variety of fluids may be deposited by a droplet deposition head. For instance, a droplet deposition head may eject droplets of fluid that may travel to a sheet of paper or card, or to another receiving medium, such as textile or foil or shaped articles (e.g. cans, bottles etc.), to form an image, as is the case in inkjet printing applications, where the droplet deposition head may be an inkjet printhead or, more particularly, a drop-on-demand inkjet printhead.

Web presses and cut sheet presses have demanding data rates. The resolution and receiving medium speed are both high [600 dpi and 800 fpm (160 ips or 4 m/s) with 3 grey levels]. Often two sets of printheads are needed in the down web direction to fill all the pixels in the direction of movement of the receiving medium.

Another application is wide format graphics where a scanning printhead moving as fast as 70 inch/sec (1.7 m/s) jets ultra-violet (UV) curable, solvent, or aqueous inks with multiple grey levels.

Droplet deposition heads suitable for such fluids may be generally similar in construction to printheads, with some adaptations made to handle the specific fluid in question.

Droplet deposition heads as described in the following disclosure may be drop-on-demand droplet deposition heads. In such heads, the pattern of droplets ejected varies in dependence upon the data provided to the head.

It will be clear to one skilled in the art that many improvements and modifications can be made to the foregoing exemplary embodiments without departing from the scope of the present techniques.

The invention claimed is:

1. An apparatus for controlling droplet deposition comprising:

a controller coupled to at least two groups of nozzles in an array, the controller being configured to:

encode data blocks into a data stream, each data block denoting how a respective group of nozzles of the at least two groups of nozzles is to be controlled for a droplet period; and encode fire codes into the data stream, each fire code being a reserved code indicating a timing when the respective group of nozzles is to be controlled in accordance with corresponding data blocks for the droplet period, each fire code being associated with at least one of the data blocks, wherein:

data blocks in the data stream for the respective group of nozzles precede corresponding fire codes in the data stream for the respective group of nozzles, and the controller generates the fire codes independently of the data blocks for the respective group of nozzles in the data stream, such that the position of the fire codes in the data stream is independent of the position of the corresponding data blocks.

2. The apparatus according to claim 1, wherein at least one of the fire codes follows the corresponding data blocks for the respective group of nozzles.

3. The apparatus according to claim 1, wherein at least one of the fire codes is encoded between two data blocks in the data stream; or the at least one of the fire codes interrupts a data block in the data stream.

4. The apparatus according claim 1, further comprising:

media encoder circuitry configured to generate a media signal in response to an input from a media encoder;

wherein the media encoder circuitry generates the media signal in response to operational data of an associated droplet deposition apparatus;

the data blocks are encoded in the data stream in response to print data; and the fire codes are encoded in the data stream in response to the media signal.

5. The apparatus according to claim 1, wherein the data blocks and fire codes are encoded using a first encoding scheme.

6. The apparatus according to claim 5, wherein the first encoding scheme comprises one of: 4b/5b encoding, 4b/6b encoding, 6b/8b encoding, 8b/10b encoding, 64b/66b encoding, or eight-to-fourteen modulation.

7. The apparatus according to claim 1, wherein the data stream is transmitted on a single communications channel.

8. The apparatus according to claim 1, wherein the data blocks and fire codes for the respective groups are encoded with a 1:1 mapping for each droplet period.

9. The apparatus according to claim 1, wherein each data block comprises a control symbol denoting at least one of: a start of the data block or an end of the data block.

10. The apparatus according to claim 1, wherein the controller is further configured to encode at least two data blocks sequentially into the data stream without an intervening fire code.

11. The apparatus according to claim 1, wherein the controller is further configured to encode at least one of the firing codes into the data stream immediately after one of the data blocks that is not associated with the at least one of the firing codes.

12. An apparatus for controlling nozzles in an array, the apparatus comprising:

a switch logic configured to apply drive pulses to the nozzles; and circuitry coupled to the switch logic, wherein the circuitry is configured to:

decode a first data stream received at the apparatus;

identify, in the first data stream, data blocks for respective groups of nozzles in the array;

generate a second data stream in response to the identified data blocks, the second data stream comprising drive data to control the switch logic for a droplet period;

identify, in the first data stream, reserved codes that indicate a timing when the respective groups of nozzles are to be controlled in accordance with the corresponding data blocks; each reserved code being associated with at least one of data blocks;

wherein:

reserved codes are generated independently of the data blocks such that the position of the reserved codes in the first data stream is independent of the position of the corresponding data blocks;

generate fire signals to control the switch logic in response to the identified reserved codes; and for a first droplet period:

configure the switch logic to apply drive pulses to a first group of the nozzles in response to the drive data including first drive data and the fire signals including a first fire signal, and independently configure the switch logic to apply drive pulses to a second group of nozzles in response to the drive data including a second drive data and the fire signals including a second fire signal, the second drive data being different from the first drive data.

13. The apparatus according to claim 12, wherein the circuitry is further configured to:

for a second droplet period:

configure the switch logic to apply drive pulses to the first group of nozzles in response to the drive data including third drive data and the fire signals including a third fire signal, and independently configure the switch logic to apply drive pulses to the second group of nozzles in response to the drive data including fourth drive data and the fire signals including a fourth fire signal, the fourth drive data being different from the third drive data.

14. The apparatus according to claim 12, wherein the circuitry is further configured to:

for a second droplet period:

configure the switch logic to apply drive pulses to the first group of nozzles in response to the drive data including the first drive data and the fire signals including a third fire signal;

independently configure the switch logic to apply drive pulses to the second group of nozzles in response to the drive data including the second drive data and the fire signals including a fourth fire signal.

15. The apparatus according to claim 12, wherein the circuitry is configured to derive drive pulses from waveform data received thereat.

16. The apparatus according to claim 12, further comprising:

a storage device coupled to the circuitry and the switch logic, the storage device being configured to store the drive data and output the drive data to the switch logic, wherein the switch logic comprises an array of switches.

17. The apparatus according to claim 16, wherein the storage device comprises two or more shift register arrays; and each switch in the array of switches is associated with a respective shift register of the shift register arrays.

18. The apparatus according to claim 16, wherein each switch in the array of switches has an associated switch controller; and each switch controller controls its associated switch in response to the drive data and fire signals.

19. A method of controlling two or more groups of nozzles in an array, the method comprising:

generating, at a first controller, a first data stream comprising encoded data blocks, each encoded data block denoting how a respective group of nozzles is to be controlled for a droplet period; and encoding, at the first controller, fire codes into the first data stream, each fire code being a reserved code that indicates a timing when a respective group of nozzles is to be controlled in accordance with a corresponding data block of the encoded data blocks for the droplet period, each fire code being associated with at least one of the data blocks;

wherein:

the encoded data blocks precede corresponding fire codes for the respective group of nozzles in the data stream; and the first controller generates the fire codes independently of the data blocks for the respective group of nozzles in the data stream, such that the position of the fire codes in the data stream is independent of the position of the corresponding data blocks.

20. The method according to claim 19, further comprising:

decoding, at a second controller on a droplet deposition head, the first data stream;

identifying, at the second controller, data blocks for respective groups of nozzles in the first data stream;

identifying, at the second controller, reserved codes that indicate a timing when the respective groups of nozzles are to be controlled in accordance with corresponding data blocks in the first data stream;

generating, at the second controller, fire signals and a second data stream comprising decoded drive data for respective groups of nozzles in response to the first data stream;

configuring, by the second controller, a switch logic to apply drive pulses to a first group of nozzles for a first droplet period in response to a first decoded drive data and a first fire signal; and independently configuring, by the second controller, the switch logic to apply drive pulses to a second group of nozzles for the first droplet period in response to a second decoded drive data and a second fire signal.

21. The method according to claim 20, further comprising:

configuring, by the second controller, the switch logic to apply drive pulses to the first group of nozzles for a second droplet period in response to a third drive data and a third fire signal;

independently configuring, by the second controller, the switch logic to apply drive pulses to the second group of nozzles for the second droplet period in response to a fourth drive data and a fourth fire signal.

22. The method according to claim 20, further comprising:

configuring, by the second controller, the switch logic to apply drive pulses to the first group of nozzles for a second droplet period in response to the first drive data and a third fire signal;

independently configuring, by the second controller, the switch logic to apply drive pulses to the second group of nozzles for the second droplet period in response to the second drive data and a fourth fire signal.

* * * * *